United States Patent [19]

Hansen

[11] Patent Number: 4,531,585

[45] Date of Patent: Jul. 30, 1985

[54] SAFETY SHEAR APPARATUS AND METHOD FOR PRODUCTION WELLS

[76] Inventor: Asger Hansen, 15611 River Ridge Ct., Houston, Tex. 77068

[21] Appl. No.: 531,553

[22] Filed: Sep. 12, 1983

[51] Int. Cl.[3] ..... E21B 33/06

[52] U.S. Cl. ..... 166/297; 166/55

[58] Field of Search ..... 166/297, 55, 55.1, 84, 166/86, 88, 382, 387, 376; 251/1 A

[56] References Cited

U.S. PATENT DOCUMENTS

| | | | |
|---|---|---|---|
| 3,675,719 | 7/1972 | Slator et al. | 166/382 |
| 3,692,107 | 9/1972 | Slator et al. | 166/298 |
| 4,043,389 | 6/1977 | Cobb | 166/55 |
| 4,071,085 | 1/1978 | Grable et al. | 166/84 |

*Primary Examiner*—Stephen J. Novosad
*Assistant Examiner*—Michael Goodwin
*Attorney, Agent, or Firm*—Fulbright & Jaworski

[57] ABSTRACT

An apparatus and method for shutting in a well in the event all other control equipment on the well fails to close and hold. The apparatus includes a lower and upper tubing head in which the tubing extends from the well upwardly through the lower head and into the upper head and sealingly engages both heads. A sealing and shear ram is positioned between the heads for shearing and sealing the tubing. The shear tubing is moved away from the shear rams after shearing to allow the rams to seal. The tubing is preferably supported from only one of the tubing heads. In one embodiment the tubing is supported initially from the upper head and after shearing the lower tubing portion moves downwardly to seat on the lower tubing head for allowing the rams to seal. In another embodiment the tubing is supported from the lower head and after shearing the upper portion of the tubing is raised to allow the shear rams to seal.

11 Claims, 7 Drawing Figures

Fig. 1
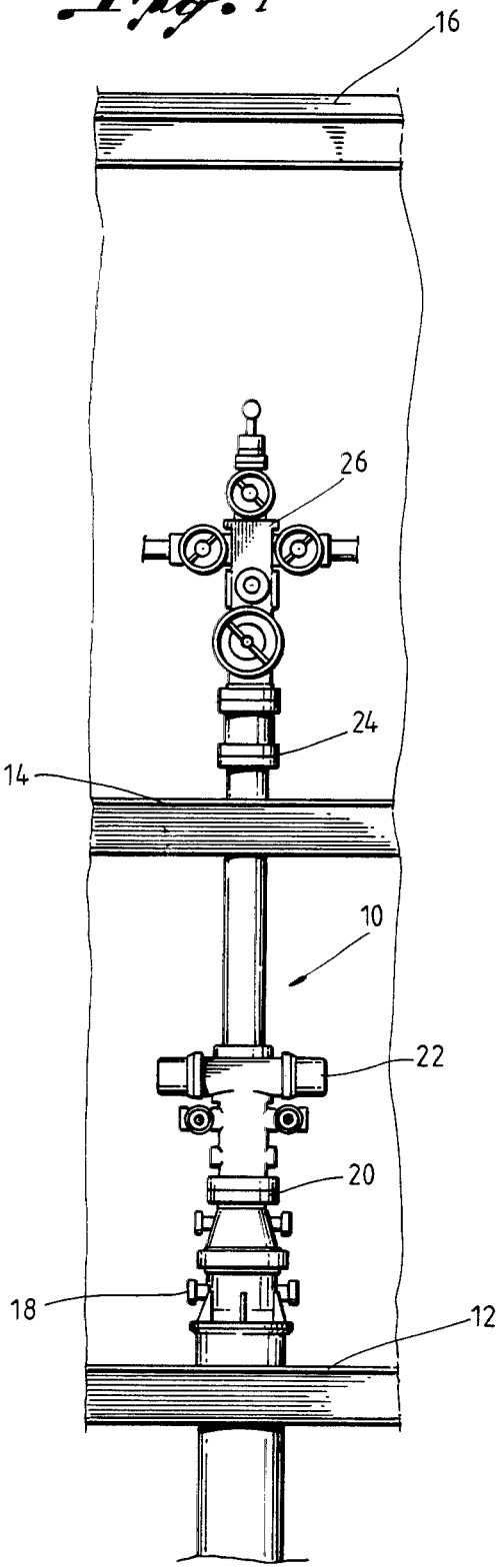
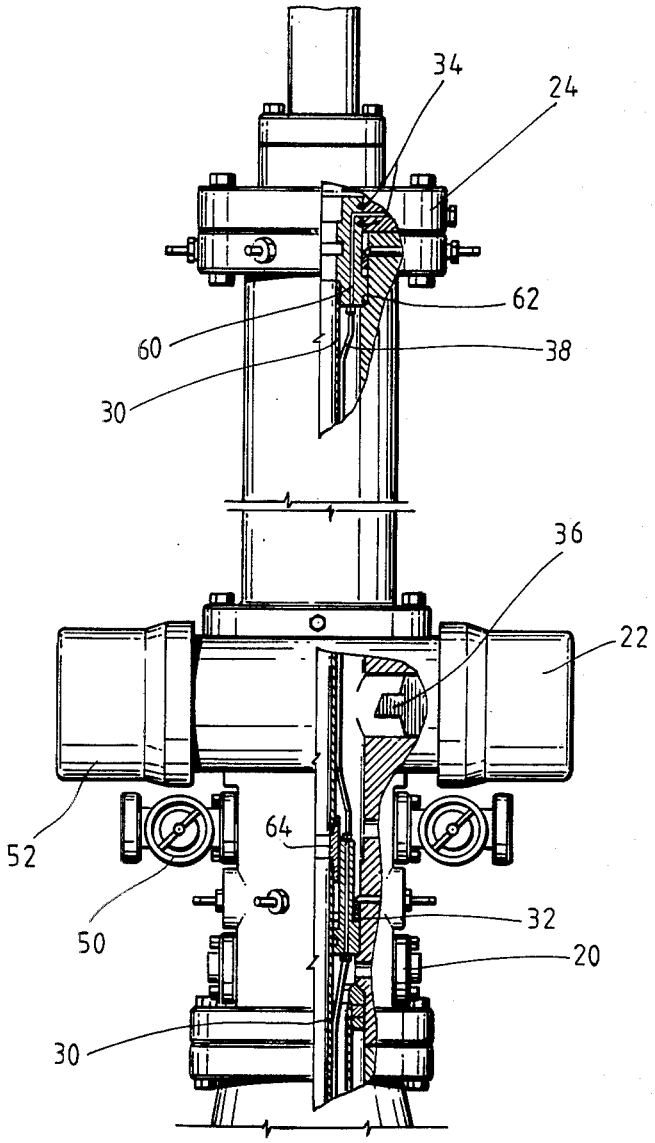
Fig. 2

SAFETY SHEAR APPARATUS AND METHOD FOR PRODUCTION WELLS

BACKGROUND OF THE INVENTION

Producing oil and/or gas wells are protected from fires by a variety of equipment such as manually actuated control valves, surface safety valves and subsurface safety valves. Nevertheless, fires do occur in which all of the control equipment on the well fails to close and hold.

The present apparatus and method is directed to a safety shear which is used as the final safety device after all others have failed. The present apparatus stays on the well and does not interfere with the well's operation and remains as the safety device until the well is shut in and abandoned. The present apparatus may be used on wells with multiple wellheads. The safety shear rams and operating mechanisms are not exposed to corrosive or abrasive well fluids and thus can be easily inspected, maintained and repaired without killing the well, but are available to shear the tubing and seal the well bore in the event of an emergency.

The present safety shear apparatus and method can be used in various configurations and in particular to configurations in which the wellhead is located remote from the production area, which is the most likely area for well fires, in order to keep fire from the wellhead. As additional safety precautions, the safety shear apparatus includes valved inlets to the well bore which are located in protective locations for killing the well. And the present safety system allows the well tubing to be pulled without removing the safety shear apparatus.

SUMMARY

The present invention is directed to a safety shear apparatus and method for use on a production oil and/or gas well which includes a lower tubing head and an upper tubing head. A tubing extends from the well upwardly through the lower head and into the upper head and the tube sealingly engages each head. A sealing and shear ram is positioned between the upper and lower heads for shearing the tubing and sealing the well bore, but is initially positioned outside of the tubing whereby the ram and working parts are isolated from the well bore fluids. Thus the sealing and shear rams may be protected, maintained and repaired during the life of the well. Means are provided for allowing the sheared tubing to move away from the shear rams after shearing to allow the rams to fully close and seal the well bore.

Still another object of the present invention is wherein the tubing is supported from only one of the tubing heads.

Yet still a further object is wherein the tubing is supported initially from the upper head and the lower tubing head includes a seat and a shoulder connected to the tubing but the shoulder is initially spaced above the seat. After the tubing is sheared, the shoulder moves downwardly to seat on the seat, preferably on a hydraulic cushion, and moves the sheared tubing away from the shear rams for allowing the rams to seal the well bore.

Still a further object is wherein the lower head includes a seal positioned below the hanger which is engaged and set by the weight of the hanger when the hanger moves downwardly onto the seat.

A still further object of the present invention is another embodiment wherein the tubing is supported initially from the lower head and telescopically engages the upper head. The rams includes lifters for raising the upper portion of the tubing whereby after the tubing is sheared the upper portion of the tubing is moved upwardly to allow the shear rams to seal the well bore.

Yet still a further object of the present invention is wherein the rams are enclosed in horizontally extending bonnets and the ram heads includes valve outlets from the tubing bore positioned under the bonnets for protection from damage.

The method of the present invention is directed to shutting in a producing oil and/or gas well in an emergency by sealing a producing tubing to upper and lower vertically spaced tubing heads and through a sealing shear ram positioned between the heads whereby in normal production the rams are isolated from the well bore fluids in the tubing. In an emergency the rams are actuated to shear the tubing and a portion of the sheared tubing is moved away from the rams after shearing for allowing the rams to seal and close the well bore. In one embodiment, the tubing is initially supported from the upper head and after shearing the lower portion of the tubing is moved downwardly to seat on the lower tubing head for moving the lower portion of the tubing away from the shear rams. In another embodiment the tubing is initially supported by the lower head and telescopically engages the upper head and after shearing, the upper portion of the tubing is raised to allow the shear rams to seal.

Other and further objects, features and advantages will be apparent from the following description of presently preferred embodiments of the invention, given for the purpose of disclosure, and taken in conjunction with the accompanying drawings where like character references designate like parts throughout the several views.

BRIEF DESCRIPTION OF THE DRAWINGS

FIG. 1 is an elevational view of one configuration of a wellhead in which the present invention can be used, FIG. 2 is an enlarged elevational view, partly in cross section, of one embodiment of the present invention.

DESCRIPTION OF THE PREFERRED EMBODIMENT

Figure 6:
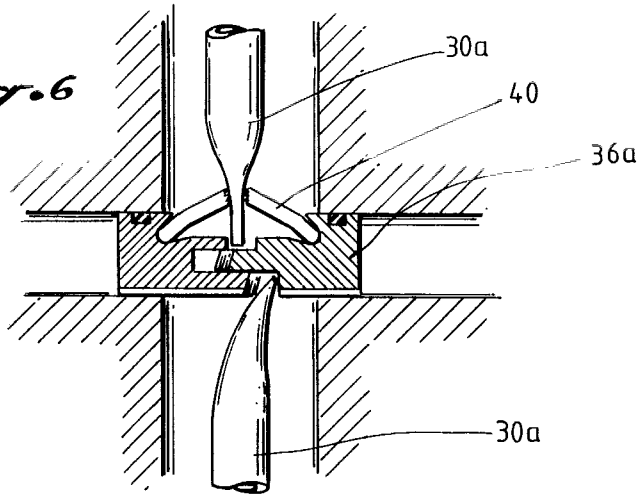
FIG. 6 is a schematic elevational view, in cross section, of the ram lifters raising the upper portion of the sheared pipe in the embodiment of FIGS. 4 and 5.

Referring now to the drawings, and particularly to FIG. 1, FIG. 1 illustrates one configuration or option in which the present invention may be utilized. The reference numeral 10 generally indicates a production oil and/or gas well on a production platform having a main deck 12 and a mezzanine deck 14 and an impact floor 16. The well includes a conventional starting head 18, a lower tubing head 20, a shear head 22, an upper tubing head 24 and a conventional Christmas Tree 26. A conventional production well 10 generally has various control equipment for closing off or shutting in the production of the well in the case of fire whereby the produced oil and/or gas from the well 10 is shut off to prevent its contributing to supplying fuel for the fire. However, in some cases, all of the control equipment on the well fails to close and hold and prevent the well production fluids from escaping into the environment. In the present invention the shear head 22 shears the well tubing, seals the well bore, allows the well to be killed if desired, and allows the system to be restored to its original condition. It is to be noted that the shear head 22, the starting head 18 and the lower tubing head 20 can be located on the main deck 12 away from the production area which is the most likely area for well fires.

Figure 3:
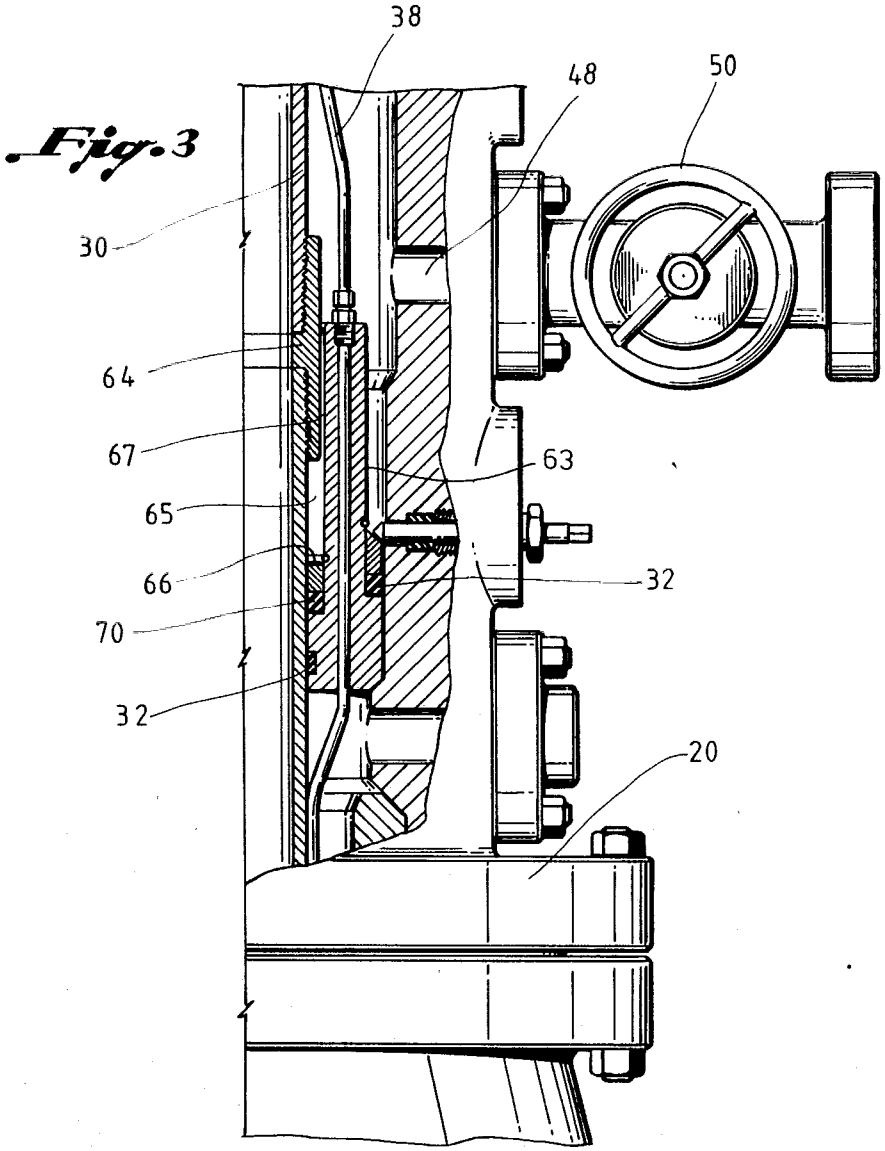
FIG. 3 is an enlarged fragmentary elevational view showing the lower tubing head of FIG. 2.

Referring now to FIGS. 2 and 3, one embodiment of the present invention is best seen in which the well tubing 30 extends upwardly from the well through the lower tubing head 20, shear head 22 and upward tubing head 24. The tubing 30 sealingly engages each of the heads 20 and 24. Thus tubing 30 is sealed in the head 20 by one or more seals 32 and is sealed in the head 24 by one or more seals 34. It is to be noted that the tubing 30 extends through the shear head 22 and thereby isolates the shear rams 36 and the operating mechanisms of the shear head 22 from the corrosive and well bore fluids in the tubing 30 during normal operation. Thus, the shear head 22 by being isolated from the well fluid may be inspected, maintained and repaired without stopping production from the well.

While the shear head 22 may be of any suitable type of shear ram, it is preferably of the type sold under the trademark J-LINE by Koomey, Inc., but with the lifters removed, and which is the subject of copending patent application entitled Valves, Ser. No. 446,390, filed Dec. 2, 1982. Normally, the well 10 is protected by various controls such as the Christmas Tree 26, surface safety valves (not shown) and subsurface safety valves (not shown) controlled by hydraulic line 38. However, in the event that all of the controls fail, the ram head 22 is actuated to shear the tubing 30 and seal off the well bore thereby preventing the escape of well fluids to the environment. However, in the event that there is no emergency, requiring the shear head 22 to be actuated, it merely remains on the well 10 until the well is shut in and abandoned. The shear head 22 does not interfere with normal operations and the tubing 30 and any connected equipment therethrough may be pulled, and inspected as required.

However, in the event that an emergency is encountered, the shear ram 22 is actuated to shear the tubing 20. While the shear rams 36 also includes seals to coact with each other to seal off the well bore, the sheared tubing must be moved away from the rams after shearing for allowing the rams to fully close and actuate the seals.

Preferably, the tubing 30 is supported initially from only one of the tubing heads 20 or 24. In this embodiment of FIGS. 2 and 3 the tubing 30 is initially supported from a hanger 60 positioned on a seat 62 in the upper tubing head 24. In the lower tubing head 20 (FIGS. 2 and 3) a shoulder, such as collar 64 connected to the tubing 30 is initially spaced above a seat of a hanger 63 66. However, the well tubing 30 is sealingly engaged with both the upper tubing head 24 and the lower tubing head 20 by one or more seals 34 and 32, respectively. Thus the tubing 30 isolates the ram head 22 from well fluids. If desired, an additional seal 70 may be provided positioned below the collar 64 for purposes as will be described later herein. In addition, the hydraulic control line 38 to a subsurface safety valve may also run through the shear head 22 if desired. As has been mentioned, the shear head 22 is only actuated in the event of an emergency. In the event of an emergency, the shear head 22 is actuated and the rams 36 engage the tubing 30 and the hydraulic control line 38 and shear them. In this particular embodiment, ram lifters are not required as after the tubing 30 is sheared, as the lower portion of the sheared tubing 30 moves downwardly until the collar 64 seats on the seat 66 of hanger 63 to support the tubing 30. Downward movement of the sheared tubing 30 moves the tubing away from the shear rams 36 for allowing the rams to shear. Downward movement of tubing 30 also leaves room above the sheared lower portion of the tubing 30 for later circulating fluid in the sheared "fish ". The collar 64 moves downwardly and engages seal 70 and weight sets the seal 70. However, a chamber 65 is formed below the collar 64 having a restricted outlet 67. The chamber is adapted to receive liquid such as ethylene glycol to provide a hydraulic cushion as the collar 64 moves into the chamber 65.

The embodiment of FIG. 2 combines the shear head 22 with the lower tubing head 20 thereby reducing height and eliminating one flange to further move the shearing head 22 away from the more dangerous upper area. In addition, the shear head 22 includes one or more side outlets 48 controlled by valves 50 which are positioned under the horizontally extending bonnet 52 of the shear head 22 to protect the valves 50 from falling objects. The valves 50 and outlet 48 may be used to kill the well with fluids, if desired, after the tubing 30 is sheared and sealed. After the well is killed, the shear head 22 may be opened and the system restored to its original condition.

Figure 7:
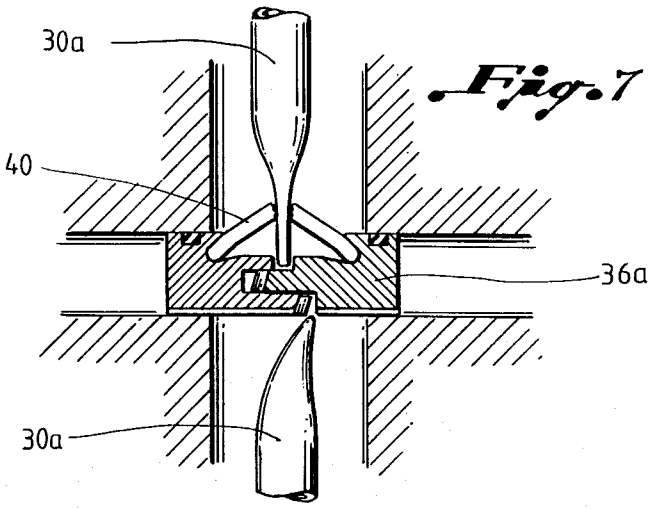
FIG. 7 is a schematic elevational view, in cross section, showing the rams sealing off the well bore after lifting the sheared tubing in FIG. 6.
Figure 5:
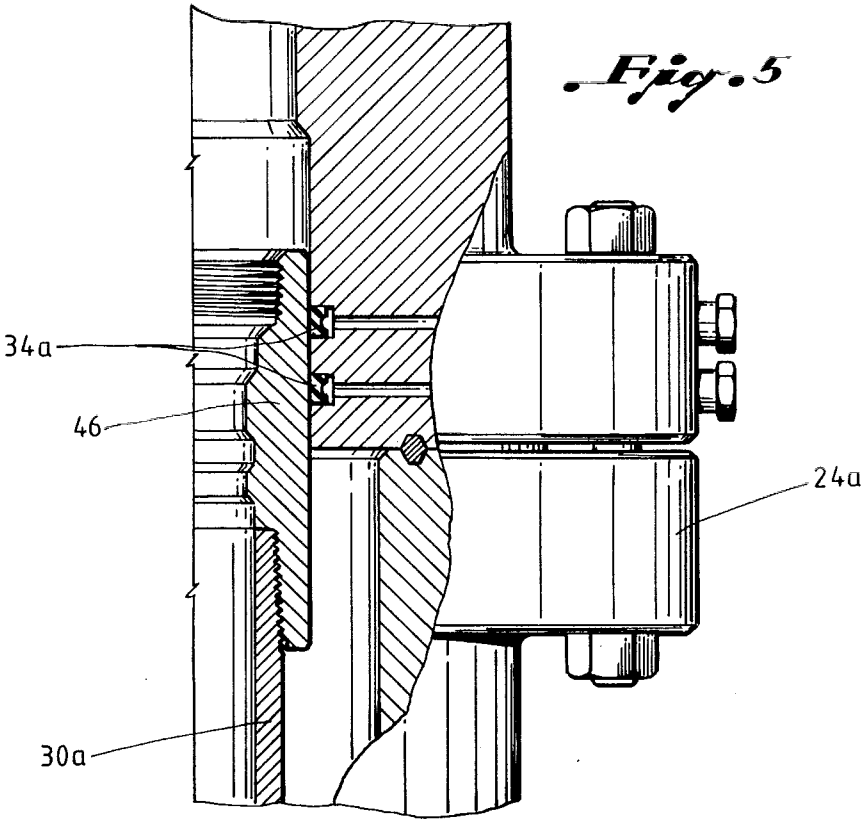
FIG. 5 is an enlarged fragmentary elevational view of the upper tubing head of FIG. 4.
Figure 4:
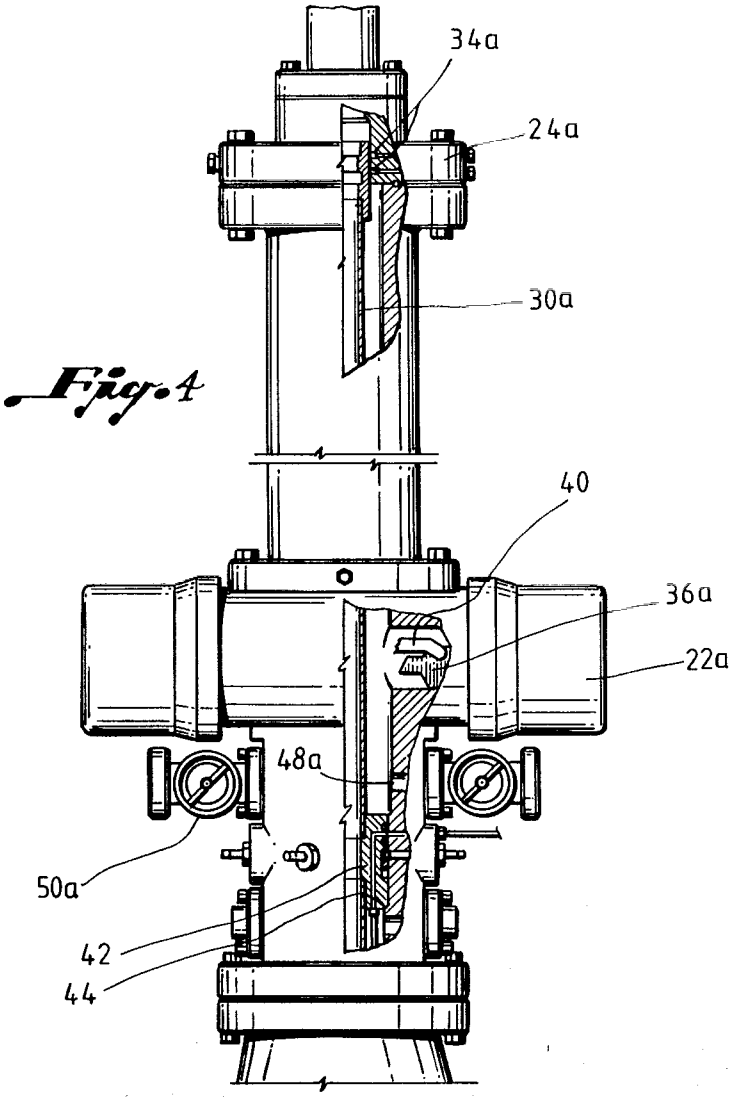
FIG. 4 is an enlarged elevational view, partly in cross section, of another embodiment of the present invention, shown in its initial position.

Referring now to FIGS. 4 and 5, another embodiment is shown wherein like parts to those of FIGS. 2 and 3 are similarly numbered with the addition of the suffix "a". In the embodiment shown in FIGS. 4 and 5, after the tubing **30*a* is sheared, the upper portion of the tubing 30*a* is lifted by the lifters 40 on the rams 36*a* sufficient to allow the sheared tubing to clear the packing and allow the rams to seal all as best seen in the sequences of FIGS. 6 and 7. In the embodiment shown in FIGS. 4 and 5, the tubing 30*a* is supported from the lower tubing head 20*a* by a hanger 42 seated on a seat 44. The upper end of the tubing 30*a* includes a sub 46 which telescopically engages the upper head 24*a*. Thus, when the shear head 22*a* shears the tubing 30*a*, it raises the sheared upper portion by the lifters 40 telescoping the sub 46 upwardly in the head 24*a*, but the lower sheared portion of the tubing 30*a* remains in place seated in the tubing head 20*a***.

Again, the embodiment of FIGS. 4 and 5 includes fluid outlets **48*a* and valve 50*a* protected beneath the shear head 22*a***.

The embodiment of FIGS. 4 and 5, as in the embodiment of FIGS. 2 and 3, is a final safety device when all others have failed. Both have the advantage in that the well bore fluids do not contact the safety shear rams and operating mechanisms during normal operation as the well tubing is sealed against both the lower and upper tubing heads. The various embodiments allow the tubing to move up or down a measured amount as the rams shear the tubing which allows the ram to seal across a broad elastomer seal. The shear heads allow communication through the outlets below the rams into the tubing bore after shearing to seal the well, but the outlets are located under the bonnets as an added precaution to prevent damage from falling objects. After the well is killed, it is relatively simple to lift the tubing and restore the system to its original condition.

The method of the present invention is apparent from the foregoing discussion of the apparatus and its operation. However, the method comprehends the method of shutting in a production oil and/or gas well in an emergency by sealing a production tubing to upper and lower vertically spaced tubing heads and through a sealing shear ram positioned between the heads whereby in normal production the rams are isolated from the well bore fluids in the tubing. In an emergency, the rams are actuated to shear the tubing and a portion of the sheared tubing is moved away from the rams after shearing for allowing the rams to seal. The method further comprehends wherein the tubing is supported initially from only one of the tubing heads. The method further comprehends wherein the tubing is initially supported from the upper head and after shearing the lower portion of the tubing is moved downwardly to seat on the lower tubing head thereby moving the lower portion of the tubing away from the shear rams for allowing the shear rams to seal. The method further comprehends wherein the downwardly moving tubing moves on a hydraulic cushion and seats on a seal which is pressure set by the weight of the tubing. The method further includes wherein the tubing is supported by the lower head and telescopically engages the upper head whereby after shearing, the upper portion of the tubing is raised to allow the shear rams to seal.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, and steps of the process may be made which will readily suggest themselves to those skilled in the art and which are encompassed within the spirit of the invention and the scope of the appended claims.

What is claimed is:

1. A safety shear apparatus for use on a production oil and/or gas well comprising, a lower tubing head, an upper tubing head, a tubing extending from the well upwardly through the lower head and into the upper head, said tubing sealingly engaging each head, means for supporting the tubing from only one of the tubing heads, sealing and shear rams positioned between the lower and upper heads for shearing the tubing and sealing and positioned outside of the tubing whereby the rams are isolated from the well bore fluids flowing through the tubing, and means for allowing the sheared tubing to move away from the shear rams a predetermined distance after shearing to allow the rams to seal.

2. The apparatus of claim 1 wherein the tubing is supported initially from the upper head, and the lower tubing head includes a seat, and a shoulder connected to the tubing initially spaced above the seat whereby after the tubing is sheared the shoulder moves downwardly to seat on the seat and move the tubing away from the shear rams for allowing the rams to seal.

3. The apparatus of claim 2 wherein the lower head includes a seal positioned between the shoulder and a hanger which is engaged by and set by the weight of the tubing when the shoulder moves downwardly onto the seat.

4. The apparatus of claim 2 including means defining a chamber positioned below the shoulder with a restricted outlet for receiving liquid which provides a hydraulic cushion as the shoulder moves into the chamber.

5. The apparatus of claim 1 wherein the tubing is supported from the lower head and telescopically engages the upper head, and the rams include lifters for raising the upper portion of the tubing whereby after the tubing is sheared the upper portion of the tubing moves upwardly to allow the shear rams to seal.

6. The apparatus of claim 1 wherein the rams are enclosed in horizontally extending bonnets, and the ram includes valved outlets from the tubing bore positioned under the bonnets for protection from damage.

7. A method of shutting in a producing oil and/or gas well in an emergency comprising, sealing a production tubing to upper and lower vertical spaced tubing heads, said tubing extending through sealing shear rams which are positioned between the heads whereby in normal production the rams are isolated from the well bore fluids in the tubing, supporting the tubing from only one of the tubing heads, in an emergency actuating the rams to shear the tubing, and moving a portion of the sheared tubing away from the rams after shearing for a predetermined distance for allowing the rams to seal.

8. The method of claim 7 wherein the tubing is initially supported from the upper head, and after shearing the lower portion of the tubing is moved downwardly to seat on the lower tubing head and moves the lower portion of the tubing away from the shear rams for allowing the rams to seal.

9. The method of claim 8 wherein the downwardly moving tubing seats on a seal which is pressure set by the weight of the tubing.

10. The method of claim 9 wherein the downwardly moving tubing moves on a hydraulic cushion prior to seating on the seal.

11. The method of claim 7 wherein the tubing is supported by the lower head and telescopically engages the upper head, and after shearing the upper portion of the tubing is raised by the shear rams to allow the shear rams to seal.

* * * * *